US010675494B2

(12) United States Patent
Hagge et al.

(10) Patent No.: US 10,675,494 B2
(45) Date of Patent: Jun. 9, 2020

(54) COLORANT FOR SOLID FIRE SUPPRESSION AGENT

(71) Applicant: Kidde Technologies, Inc., Wilson, NC (US)

(72) Inventors: Harlan Hagge, Knightdale, NC (US); Adam Chattaway, Berkshire (GB); Terry Simpson, Wake Forest, NC (US)

(73) Assignee: Kidde Technologies, Inc., Wilson, NC (US)

( * ) Notice: Subject to any disclaimer, the term of this patent is extended or adjusted under 35 U.S.C. 154(b) by 130 days.

(21) Appl. No.: 15/935,640

(22) Filed: Mar. 26, 2018

(65) Prior Publication Data

US 2019/0290951 A1 Sep. 26, 2019

(51) Int. Cl.
*A62D 1/00* (2006.01)

(52) U.S. Cl.
CPC ..... *A62D 1/005* (2013.01); *A62D 1/0092* (2013.01)

(58) Field of Classification Search
CPC ..... A62D 1/005; A62D 1/0092
See application file for complete search history.

(56) References Cited

U.S. PATENT DOCUMENTS 2,393,874 A * 1/1946 Trent ..... C09D 167/08 106/259
3,238,129 A 3/1966 Veltman
4,400,297 A * 8/1983 Cruz, Jr. ..... C09K 21/02 106/467
4,420,047 A * 12/1983 Bruensicke ..... A62C 5/02 169/53
4,515,633 A * 5/1985 Cruz, Jr. ..... C09K 21/02 106/122
5,716,711 A * 2/1998 Calder ..... C04B 41/009 156/287
6,065,545 A 5/2000 Williams
2001/0035517 A1 11/2001 Crouch et al.
2002/0189492 A1* 12/2002 Vandersall ..... C09D 5/18 106/18.11
2007/0034823 A1* 2/2007 Hagquist ..... A62C 2/065 252/2
2011/0030577 A1* 2/2011 Lim ..... E04B 1/76 106/15.05
2011/0163252 A1 7/2011 Sallen Rosello
2015/0041159 A1* 2/2015 Goodwin ..... A62D 1/005 169/45
2015/0175815 A1* 6/2015 Goodwin ..... C09D 5/18 428/446
2016/0030789 A1 2/2016 Cordani
2019/0290950 A1* 9/2019 Hagge ..... A62D 1/005

FOREIGN PATENT DOCUMENTS

WO WO91/11498 A1 8/1991

OTHER PUBLICATIONS

Extended European Search Report for EP Application No. 19164757.7, dated Jul. 3, 2019, 7 pages.

* cited by examiner

*Primary Examiner* — Joseph D Anthony
(74) *Attorney, Agent, or Firm* — Kinney & Lange, P.A.

(57) ABSTRACT

A fire suppression agent includes a fluid medium, vermiculite particles suspended in the fluid medium, and a colorant additive proximate at least a subset of the vermiculite particles. The fire suppression agent is capable of suppressing a fire comprising a combustible metal material.

20 Claims, 2 Drawing Sheets

COLORANT FOR SOLID FIRE SUPPRESSION AGENT

BACKGROUND

Solid particle fire suppression agents require clean-up after agent discharge, or in the event of a leak or spill. Many existing solid particle fire suppression agents are beige, white, or brown in color. When used in an aircraft cargo hold or other compartment, these agents can be difficult to see, because of the similarly colored compartment surfaces. Thus, a need exists for a more visible fire suppression agent to facilitate clean-up of the agent against certain backdrops.

SUMMARY

A fire suppression agent includes a fluid medium, vermiculite particles suspended in the fluid medium, and a colorant additive proximate at least a subset of the vermiculite particles. The fire suppression agent is capable of suppressing a fire comprising a combustible metal material.

A method of making a colorized fire suppression agent suitable for suppressing a fire comprising a combustible metal material includes combining a colorant additive and vermiculite particles, and suspending the colorant additive and vermiculite particles in a fluid medium.

DETAILED DESCRIPTION

The present invention is directed to a fire suppression agent containing solid particles, and a powderized colorant added to the fire suppression agent to enhance visibility of the particles after discharge of the agent. More specifically, the solid particles are vermiculite particles, a flaky mineral having a brownish color. The particles are combined with the solid particles and can be loosely or more tightly associated with the solid particles within the agent.

Figure 1:
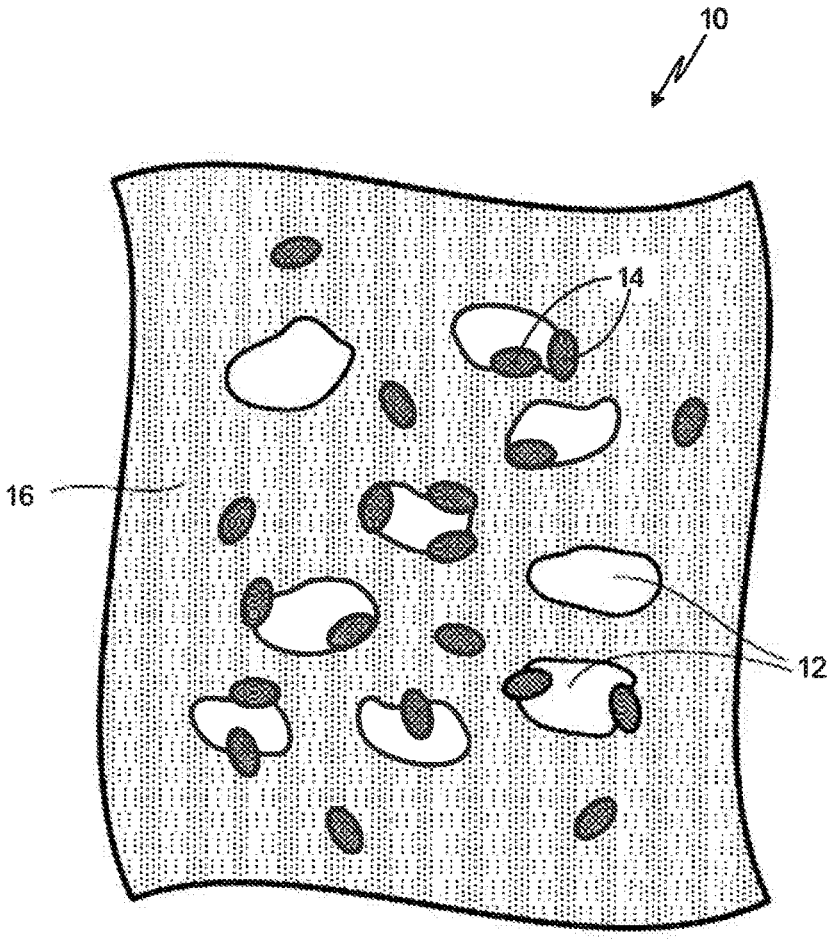
FIG. 1 is a simplified illustration of fire suppression agent containing a colorant additive.

FIG. 1 is a simplified illustration of fire suppression agent 10. In the embodiment shown, fire suppression agent 10 is a hybrid fire suppression agent and includes vermiculite particles 12 and colorant particles 14 suspended in fluid medium 16. The vermiculite can be effective at fighting class D (combustible metal) fires. Fluid medium 16 can also be a fire suppression agent capable of fighting class A (combustible nonmetal solids), class B (combustible fluids) and class C (electrical) fires.

Vermiculite particles 12 can range from about 1 micron to 300 microns in diameter. In an exemplary embodiment, the Dv90 diameter (the diameter of particles occupying 90% of the total volume) is less than 200 microns, while the Dv50 diameter (median diameter) is less than 85 microns. Further, the concentration of vermiculite particles 12 within fire suppression agent 10 ranges from about 5% to 40% by weight, and in an exemplary embodiment, from about 13% to 20% by weight.

Colorant particles 14 can range from about 1 micron to 10 microns in diameter, and in some cases, can have a submicron diameter. In an exemplary embodiment, the Dv90 diameter is less than 9 microns. The concentration of colorant particles 14 within fire suppression agent 10 ranges from about 0.1% to 5.0% by weight. The concentration of the colorant particles can vary so as not to interfere with the fire suppression properties of the other substances within fire suppression agent 10.

Colorant particles 14 can be a relatively vivid color, (e.g., blue, red, orange, etc.), and can be formed from a non-toxic or low toxicity material such as a dye or salt used as a color additive in food, cosmetics, and pharmaceuticals. Exemplary additives can include one or a combination of Brilliant Blue FCF (Blue No. 1), Indogotine (Blue No. 2), Fast Green FCF (Green No. 3), Erythrosine (Red No. 3), Allura Red (Red No. 40), Tartrazine (Yellow No. 5), and Sunset Yellow FCF (Yellow No. 6). Pigments used in inks and plastics, such as indigo, alizarin, cochineal red, phthalo green, iron oxide, titanium dioxide, and cobalt blue, can also be used. Other suitable color additives, pigments, and low toxicity organic and inorganic materials are contemplated herein. In some embodiments, colorant particles 14 can additionally or alternatively be photoluminescent (e.g., fluorescent or phosphorescent) to further enhance the visibility of discharged vermiculite particles 12.

Fluid medium 16 can be an aqueous or non-aqueous liquid or a liquefied compressed gas fire suppression agent and can include, for example, fluorocarbons and halocarbons. Exemplary agents can include one or a combination of 2-BTP (2-bromo-3,3,3-trifluoropropene), HFC-236fa (1,1,1,3,3,3-hexafluoropropane), HFC-125 (pentafluoroethane), HFC-227ea (1,1,1,2,3,3,3-heptafluoropropane), Novec 1230 ($C_6F_{12}O$), and trifluoromethyliodide ($CF_3I$). Other agents and combinations of agents are contemplated herein, and may be selected based on fire suppression needs and vermiculite compatibility.

Figure 2:
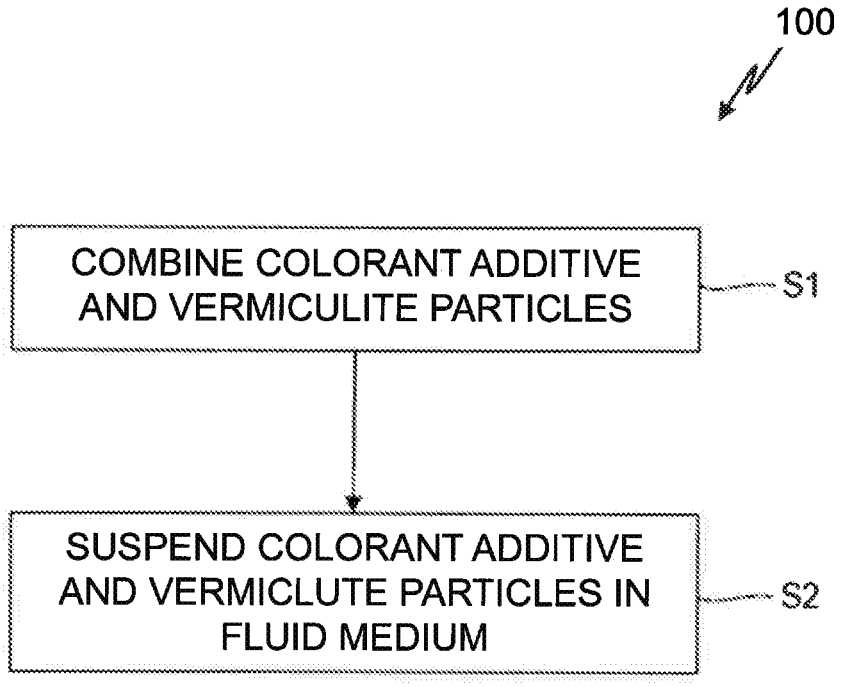
FIG. 2 illustrates the steps of making the fire suppression agent.

FIG. 2 illustrates method 100 of making fire suppression agent 10. At step S1, colorant particles 14 can be combined with vermiculite particles 12. To create a looser association between vermiculite particles 12 and colorant particles 14, the two can simply be mixed together, or the vermiculite can be dusted with the colorant. To create a tighter association between vermiculite particles 12 and colorant particles 14, vermiculite particles 12 can be coated with colorant particles 14 using, for example, a film coating or fluidized bed coating technique. Depending on the embodiment, colorant particles 14 are associated with or coat fewer than 100% of the vermiculite particles 12, and further, to less than 100% of the surface area of an individual vermiculite particle 12. In an exemplary embodiment, colorant particles 12 can be associated with or coat 20% or less of the surface area of an individual vermiculite particle 12. This prevents colorant particles 14 from interfering with the ability of vermiculite particles 12 to smother a fire and starve it of oxygen, while still enhancing vermiculite visibility.

At step S2, the combined colorant particles 14 and vermiculite particles 12 can be suspended in fluid medium 16. This can be carried out, for example, by placing the particles in one or more pressure vessels (e.g., portable extinguisher, tank for a fixed system, etc.), and adding fluid medium 16. In some embodiments, the colorant-vermiculite mixture can be suspended in fluid medium 16 within the vessel(s), while in other embodiments, the mixture can be stored separately from fluid medium 16 (e.g., in a separate vessel or chamber within a single vessel). In such a case, the mixture and fluid medium 16 remain separate until triggered to mix upon or just before discharge.

The disclosed fire suppression agent has many benefits. The colorant allows for easier visualization of discharged vermiculite particles, which facilitates clean-up. Besides commercial aircraft, the disclosed fire suppression agent and system can be used in private and cargo aircraft, other transportation industries (automotive, maritime, etc.), factories, laboratories, and more.

Discussion of Possible Embodiments

The following are non-exclusive descriptions of possible embodiments of the present invention.

A fire suppression agent includes a fluid medium, vermiculite particles suspended in the fluid medium, and a colorant additive proximate at least a subset of the vermiculite particles. The fire suppression agent is capable of suppressing a fire comprising a combustible metal material.

The fire suppression agent of the preceding paragraph can optionally include, additionally and/or alternatively, any one or more of the following features, configurations and/or additional components:

In the above fire suppression agent, a concentration of the vermiculite particles can range from 5% to 40% by weight.

In any of the above fire suppression agents, a concentration of the colorant can be 5.0% or less by weight.

In any of the above fire suppression agents, the colorant can be a finely divided powder comprising individual colorant particles.

In any of the above fire suppression agents, a Dv90 diameter of the colorant particles can be less than 9 microns.

In any of the above fire suppression agents, a Dv90 diameter of the vermiculite particles can be less than 200 microns.

In any of the above fire suppression agents, the colorant can include a substance selected from the group consisting of Brilliant Blue FCF (Blue No. 1), Indogotine (Blue No. 2), Fast Green FCF (Green No. 3), Erythrosine (Red No. 3), Allura Red (Red No. 40), Tartrazine (Yellow No. 5), Sunset Yellow FCF (Yellow No. 6), indigo, alizarin, cochineal red, phthalo green, iron oxide, titanium dioxide, cobalt blue, and combinations thereof.

In any of the above fire suppression agents, the colorant can be photoluminescent.

In any of the above fire suppression agents, the colorant can in physical contact with 20% or less of a surface area of an individual vermiculite particle.

In any of the above fire suppression agents, the fire suppression agent can further be capable of suppressing a fire comprising at least one of a combustible nonmetal solid, a combustible fluid, and an electrical component.

A method of making a colorized fire suppression agent suitable for suppressing a fire comprising a combustible metal material includes combining a colorant additive and vermiculite particles, and suspending the colorant additive and vermiculite particles in a fluid medium.

The method of the preceding paragraph can optionally include, additionally and/or alternatively, any one or more of the following features, configurations and/or additional components:

The above method can further include, placing the colorant, vermiculite particles, and fluid medium in a vessel to create a fire suppression system.

In any of the above methods, combining the colorant and the vermiculite particles can include coating the vermiculite particles with the colorant.

In any of the above methods, coating the vermiculite particles can include film coating the vermiculite particles.

In any of the above methods, combining the colorant and the vermiculite particles can include mixing the colorant with the vermiculite particles.

In any of the above methods, a concentration of the vermiculite particles can range from 5% to 40% by weight.

In any of the above methods, a concentration of the colorant can be 5.0% or less by weight.

In any of the above methods, the colorant can be a finely divided powder made up of individual colorant particles, and a Dv90 diameter of the colorant particles can be less than 9 microns.

In any of the above methods, the colorant can include a substance selected from the group consisting of Brilliant Blue FCF (Blue No. 1), Indogotine (Blue No. 2), Fast Green FCF (Green No. 3), Erythrosine (Red No. 3), Allura Red (Red No. 40), Tartrazine (Yellow No. 5), Sunset Yellow FCF (Yellow No. 6), indigo, alizarin, cochineal red, phthalo green, iron oxide, titanium dioxide, cobalt blue, and combinations thereof.

In any of the above methods, the colorant can be photoluminescent.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fire suppression agent comprising:

a fluorocarbon or halocarbon fluid medium;

vermiculite particles suspended in the fluid medium; and a colorant additive suspended in the fluid medium and proximate at least a subset of the vermiculite particles;

wherein the fire suppression agent is capable of suppressing a fire comprising a combustible metal material.

2. The fire suppression agent of claim 1, wherein a concentration of the vermiculite particles ranges from 5% to 40% by weight.

3. The fire suppression agent of claim 1, wherein a concentration of the colorant is 5.0% or less by weight.

4. The fire suppression agent of claim 1, wherein the colorant is a finely divided powder comprising individual colorant particles.

5. The fire suppression agent of claim 4, wherein a Dv90 diameter of the colorant particles is less than 9 microns.

6. The fire suppression agent of claim 1, wherein a Dv90 diameter of the vermiculite particles is less than 200 microns.

7. The fire suppression agent of claim 1, wherein the colorant comprises a substance selected from the group consisting of Brilliant Blue FCF (Blue No. 1), Indogotine (Blue No. 2), Fast Green FCF (Green No. 3), Erythrosine (Red No. 3), Allura Red (Red No. 40), Tartrazine (Yellow No. 5), Sunset Yellow FCF (Yellow No. 6), indigo, alizarin, cochineal red, phthalo green, iron oxide, titanium dioxide, cobalt blue, and combinations thereof.

8. The fire suppression agent of claim 1, wherein the colorant is photoluminescent.

9. The fire suppression agent of claim 1, wherein the colorant is in physical contact with 20% or less of a surface area of an individual vermiculite particle.

10. The fire suppression agent of claim 1, wherein the fire suppression agent is further capable of suppressing a fire comprising at least one of:

a combustible nonmetal solid;

a combustible fluid; and an electrical component.

11. A method of making a colorized fire suppression agent suitable for suppressing a fire comprising a combustible metal material, the method comprising:

combining a colorant additive and vermiculite particles; and suspending the colorant additive and vermiculite particles in a fluorocarbon or halocarbon fluid medium.

12. The method of claim 11, and further comprising: placing the colorant, vermiculite particles, and fluid medium in a vessel to create a fire suppression system.

13. The method of claim 11, wherein combining the colorant with the vermiculite particles comprises coating the vermiculite particles with the colorant.

14. The method of claim 13, wherein coating the vermiculite particles comprises film coating the vermiculite particles.

15. The method of claim 11, wherein combining the colorant with the vermiculite particles comprises mixing the colorant with the vermiculite particles.

16. The method of claim 11, wherein a concentration of the vermiculite particles ranges from 5% to 40% by weight.

17. The method of claim 11, wherein a concentration of the colorant is 5.0% or less by weight.

18. The method of claim 11, wherein the colorant is a finely divided powder comprising individual colorant particles, and wherein a Dv90 diameter of the colorant particles is less than 9 microns.

19. The method of claim 11, wherein the colorant comprises a substance selected from the group consisting of Brilliant Blue FCF (Blue No. 1), Indogotine (Blue No. 2), Fast Green FCF (Green No. 3), Erythrosine (Red No. 3), Allura Red (Red No. 40), Tartrazine (Yellow No. 5), Sunset Yellow FCF (Yellow No. 6), indigo, alizarin, cochineal red, phthalo green, iron oxide, titanium dioxide, cobalt blue, and combinations thereof.

20. The method of claim 11, wherein the colorant is photoluminescent.

* * * * *